US008376043B2

(12) United States Patent
Knobloch et al.

(10) Patent No.: US 8,376,043 B2
(45) Date of Patent: Feb. 19, 2013

(54) DOWNHOLE SCRAPING AND/OR BRUSHING TOOL AND RELATED METHODS

(75) Inventors: Benton T. Knobloch, Broussard, LA (US); Todd J. Roy, Youngsville, LA (US); Clint M. Musemeche, Youngsville, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/443,858

(22) Filed: Apr. 10, 2012

(65) Prior Publication Data

US 2012/0241145 A1 Sep. 27, 2012

Related U.S. Application Data

(63) Continuation of application No. 12/519,124, filed as application No. PCT/US2007/087287 on Dec. 12, 2007, now abandoned.

(60) Provisional application No. 60/869,712, filed on Dec. 12, 2006.

(51) Int. Cl.
*E21B 37/00* (2006.01)

(52) U.S. Cl. ..... 166/170; 166/173; 166/311

(58) Field of Classification Search ..... 166/170, 166/173, 311

See application file for complete search history.

(56) References Cited

U.S. PATENT DOCUMENTS

| | | | | |
|---|---|---|---|---|
| 6,464,010 | B1 * | 10/2002 | Brown | 166/311 |
| 6,523,612 | B2 * | 2/2003 | Reynolds | 166/312 |
| 6,530,429 | B2 * | 3/2003 | Howlett | 166/173 |
| 7,159,668 | B2 * | 1/2007 | Herrera | 166/381 |
| 7,311,141 | B2 * | 12/2007 | Tulloch et al. | 166/173 |
| 7,708,062 | B2 * | 5/2010 | Carro | 166/202 |
| 7,712,520 | B1 * | 5/2010 | Hettes | 166/173 |
| 7,836,947 | B2 * | 11/2010 | Booth | 166/175 |
| 7,870,897 | B2 * | 1/2011 | Telfer | 166/174 |
| 7,878,238 | B2 * | 2/2011 | Potter | 166/173 |
| 8,002,037 | B2 * | 8/2011 | Booth | 166/311 |
| 2006/0201670 | A1 * | 9/2006 | Stewart | 166/241.6 |
| 2007/0261855 | A1 * | 11/2007 | Brunet et al. | 166/312 |
| 2009/0272524 | A1 * | 11/2009 | Voth | 166/173 |
| 2010/0071909 | A1 * | 3/2010 | Winn | 166/381 |
| 2010/0181064 | A1 * | 7/2010 | Knobloch et al. | 166/99 |

OTHER PUBLICATIONS

*M-I, LLC* v. *Chad Lee Stelly, et al.*, In the United States District Court for the Southern District of Texas, Houston Division, C.A. No. 4:09-CV-01552, Third Amendment Complaint (Exhibits A-G were designated Attorney Eyes Only at time of filing and have been removed), Sep. 7, 2010. *M-I, LLC* v. *Chad Lee Stelly, et al.*, In the United States District Court for the Southern District of Texas, Houston Division, C.A. No. 4:09-CV-01552, Answer and Counterclaims to Plaintiff's Third Amended Complaint, Jan. 28, 2011.

*M-I, LLC* v. *Chad Lee Stelly, et al.*, In the United States District Court for the Southern District of Texas, Houston Division, C.A. No. 4:09-CV-01552, Order of Dismissal with Prejudice, Jun. 28, 2012.

* cited by examiner

*Primary Examiner* — Daniel P Stephenson

(74) *Attorney, Agent, or Firm* — Booth Albanesi Schroeder LLC; Scott Wendorff; John F. Booth

(57) ABSTRACT

An improved and enhanced spring loaded downhole tool for cleaning well casing bores comprising a mandrel, at least a first insert having a passageway therethrough, and at least a second insert, wherein both the first insert and the second insert are selected from at least one of a spring loaded scraper insert and at least one wire brush insert, and further wherein the first insert and the second insert are slidingly received within a slot on a first mounting portion on the mandrel and a slot on a second mounting portion on the mandrel, from the outermost respective ends, and wherein the first insert is secured by a first retaining sleeve and the second insert is secured by a second retaining sleeve. Also disclosed is a unique method for cleaning a section of casing with a downhole tool, as herein disclosed.

13 Claims, 7 Drawing Sheets

DOWNHOLE SCRAPING AND/OR BRUSHING TOOL AND RELATED METHODS

RELATED APPLICATIONS

The present invention claims priority to U.S. provisional application Ser. No. 60/689,712 filed on Dec. 12, 2006, the contents of which are hereby incorporated by reference.

SUMMARY OF THE INVENTION

Various embodiments of the present invention generally relate to enhanced and improved wellbore cleaning tool or tool for casing surface cleaning. Generally, a downhole tool of the present invention is connected to a string of casing, such as a drill string used in a downhole environment.

In an embodiment, a downhole tool of the present invention comprises a mandrel operatively connected to a drill string, the mandrel having at least a first slot and at least a second slot therein. A first insert with a passageway therehtrough is operatively received within the first slot and a second insert with a passageway therehtrough is operatively received within the second slot. In varying embodiments, the first and/or the second insert is either a spring loaded scraping insert or a spring loaded brush insert comprising individually spring loaded pods or a spring loaded wire brush insert, both of which spring loaded wire inserts are capable of floating within the first insert and the second insert.

Various embodiments of the present invention generally provide for enhanced casing cleaning by at least one of contoured blade design(s) to provide superior tubular coverage, engagement and/or contact; contoured blade design to promote enlarged internal bore diameters for both the scraping insert and the brushing insert; for an embodiment comprising a brushing means, independent spring loaded pods for increased; enhanced; and/or, improved brushing operations by allowing independent extension of each pod or insert; interchangeable and adaptable construction to allow for various design components; and, improved component retention designs and apparatuses to reduce incidence of tool failure.

Downhole tools of the present invention are capable of use for cleaning an internal surface of a casing string. Various modifications to various profiles of embodiments of the present invention can be made to adapt tool embodiments to varying wellbore/casing situations, such as, but not limited to agglomerations of cement, downhole isolation and cleaning plugs, downhole collars, float equipment, casing scale, casing film, casing hydrate, agglomerations of substrate, pieces of drill string, casing deviation, including highly deviated casing, and/or the like. Various profiles include, but are not limited to drilling profiles, milling profiles, slick profiles, tapered profiles, tru-gauging/drifting profiles and/or the like.

Further interchangeable adaptations possible with embodiments of the present invention include interchangeable housing portions located between the first insert and the second insert. Various embodiments of interchangeable housing portions include, but are not limited to, a blanking portion, a magnetic portion, a tru-gauge portion, combinations of the aforesaid, and/or the like.

Various other embodiments of the present invention generally comprise methods for brushing and/or scraping a surface of a casing; methods of constructing a brushing and/or scraping tool as herein described; and/or the like.

These and other features and advantages of the invention will be apparent to those skilled in the art from the following detailed description of a preferred embodiment, taken together with the accompanying figures and claims, in which:

BRIEF DESCRIPTION OF THE FIGURES

In order that the manner in which the above-recited and other enhancements and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE INVENTION

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention, the description taken with the drawings making apparent to those skilled in the art how the several forms of the invention may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary, 3rd Edition.

As used herein, the term "attached," or any conjugation thereof describes and refers the at least partial connection of two items.

As used herein, a "fluid" is a continuous, amorphous substance whose molecules move freely past one another and that has the tendency to assume the shape of its container, for example, a liquid or a gas.

As used herein, the term "integral" means and refers to lacking nothing essential after assembly.

Other than in the operating examples, or where otherwise indicated, all numbers expressing quantities of ingredients or reaction conditions used herein are to be understood as modified in all instances by the term "about".

Various embodiments of the present invention generally provide for enhanced casing cleaning by at least one of a contoured blade design to provide superior tubular coverage, engagement and/or contact; a contoured blade design to promote enlarged internal bore diameters for both the scraping insert and the brushing insert; for an embodiment comprising a brushing means, independent spring loaded pods and/or independent spring loaded wire brush insert for increased, enhanced, and/or improved brushing operations by allowing independent extension of each pod or wire brush insert; interchangeable and adaptable construction to allow for various design components; and/or, improved component retention designs and apparatuses to reduce incidence of tool failure.

Figure 1:
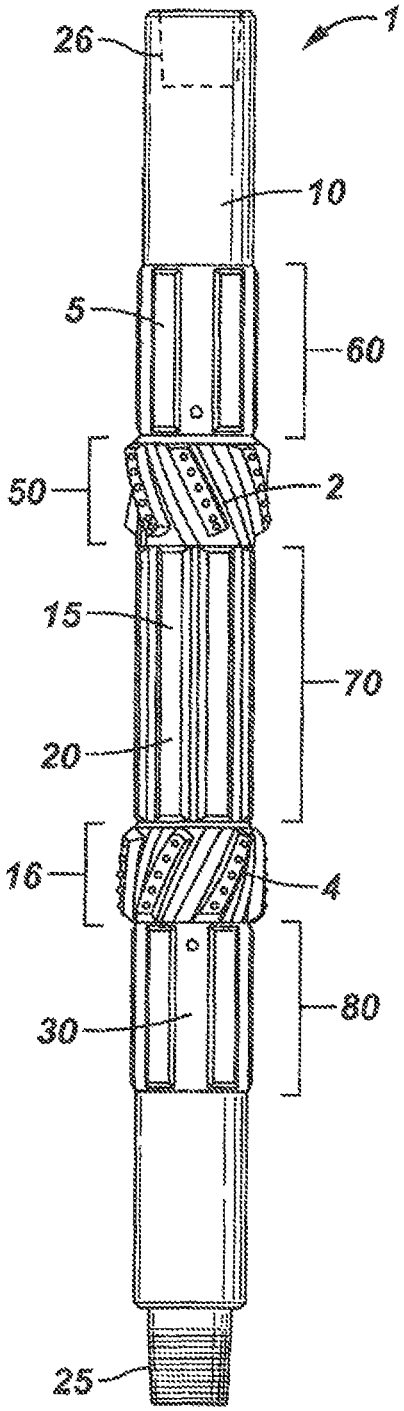
FIG. 1 is an illustration of an embodiment of a spring loaded scraping downhole tool of the present invention.

Referring to FIG. 1, an embodiment of a wellbore cleaning tool is disclosed as a spring loaded downhole tool 1 with scraping inserts is disclosed. Downhole tool 1 is commonly inserted as an integral one-piece or portion of a drill string within a wellbore. In various embodiments, tool 1 is positioned intermediate various other tools and/or drill string portions and connected through male portion 25 and female portion 26. Tool 1 is most preferred for use in casing strings that are to be cleaned. Generally downhole tool 1 comprises a mandrel 10, a first mounting portion 50, a second mounting portion 16, at least one first insert 2, at least one second insert 4, a first profile 5, and a second profile 30.

Generally, in an embodiment, mandrel 10 is of a generally similar size and/or circumference along its length with at least three cut away portions 60, 70, and 80. Cut away portion 60 is of a sufficient depth to allow mounting of insert 2 to a mounting slot within mounting portion 50. Likewise, cut away portion 80 is of a sufficient depth to allow mounting of insert 4 to a mounting slot within mounting portion 16. Cut away portion 70 is an optional component and allows for interchangeable mounting of various tool enhancers, such as, but not limited to a magnetic portion, a tru-gauge portion, a flow area enhancement portion, and/or the like.

In an alternate embodiment, first mounting portion 50 is an enlarged portion of mandrel 10 of sufficient thickness to allow machining of a mounting slot for at least one first insert 2. Likewise, in this alternate embodiment, second mounting portion 16 is an enlarged portion of mandrel 10 of sufficient thickness to allow machining of a mounting slot for at least one second insert 4.

In an alternate embodiment, mandrel 10 is of generally uniform circumference and the various further components of this invention are mounted to the mandrel.

Inserts of the present invention are inserted into at least one slot 54 cut into the mounting portions from the outermost ends and not from the center. In an embodiment, at least one insert 2 is inserted into a slot in mounting portion 50 from the outermost side and slid towards the center. Likewise, at least one insert 4 is inserted into a slot in mounting portion 16 from the outermost side and slid towards the center. All embodiments of a spring loaded brush insert comprise an insert with a passageway therehtrough.

Slots in mounting portion 50 and/or mounting portion 16 can generally be any size desired that is capable of accepting an insert. In an embodiment, the slots are wedged shaped. In an alternate embodiment, the slots are L-shaped. In an alternate embodiment, the slots allow for insertion of a tongued member. Examples of slots suitable for use with various embodiments of the present invention can be found in U.S. Pat. No. 4,479,538, the contents of which are hereby incorporated by reference.

Slots in mounting portion 50 and/or mounting portion 16 can generally be cut at any orientation and/or angle from the longitudinal axis of the mandrel that allows at least one first and at least one second insert to be inserted from the outermost side. In an embodiment, all of the slots in mounting portion 50 are cut at generally the same angle. Likewise, in an embodiment, all of the slots in mounting portion 16 are cut at generally the same angle. Any number of slots can be used in each of mounting portion 50 and mounting portion 16. In an embodiment, the angle of orientation of the at least one slot is greater than 10 degrees from the longitudinal axis of the mandrel. In an alternate embodiment, the angle of orientation is greater than 20 degrees from the longitudinal axis of the mandrel. In an alternate embodiment, the angle of orientation is greater than 30 degrees from the longitudinal axis of the mandrel. In an alternate embodiment, the angle of orientation is greater than 40 degrees from the longitudinal axis of the mandrel. In an alternate embodiment, the angle of orientation is greater than 50 degrees from the longitudinal axis of the mandrel. In an alternate embodiment, the angle of orientation is greater than 60 degrees from the longitudinal axis of the mandrel. In an alternate embodiment, the angle of orientation is greater than 70 degrees from the longitudinal axis of the mandrel. In an alternate embodiment, the angle of orientation is greater than 80 degrees from the longitudinal axis of the mandrel.

Generally, the orientation/angle and number of slots is chosen to provide 360° coverage around mounting portion 50 and/or mounting portion 16. In an alternate embodiment, 360° coverage is provided by combination of mounting portion 50 and mounting portion 16.

Figure 5:
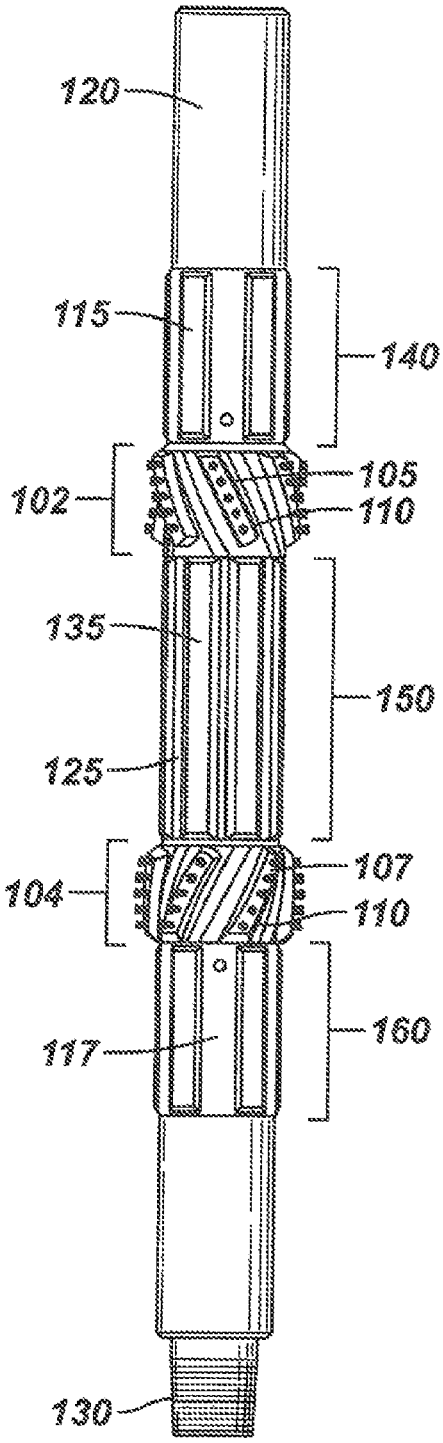
FIG. 5 is an illustration of a spring loaded wire brush downhole tool of the present invention.
Figure 6:
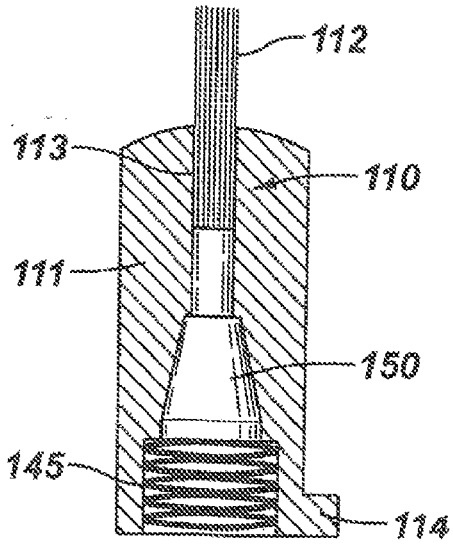
FIG. 6 is an illustration of the spring loaded wire pod insert with a passageway therehtrough from FIG. 5.

A brush insert comprising individually spring loaded pods is illustrated in FIG. 5 and are more fully disclosed with reference to FIG. 6.

Further interchangeable adaptations possible with embodiments of the present invention include interchangeable mid sections/portions located between the first insert and the second insert. Various embodiments of interchangeable housing portions include, but are not limited to, a blanking portion, a magnetic portion, a tru-gauging portion, combinations of the aforesaid, and/or the like. The embodiment in FIG. 1 illustrates a magnetic housing 15 held in place on mandrel 10 by locking dog 20, in this case, a pair of locking dogs.

As well, retaining sleeves of the present invention are interchangeable. In an embodiment, the lower retaining sleeve, retaining sleeve 30 in FIG. 1, is interchangeable between a tapered mill profile, a top dress profile, a flow area enhancement profile and/or the like. In a tapered mill profile, a degree of taper is capable of selection relative to the desired drilling, milling, fishing, displacement, workover or well intervention operation and/or the like. As well, the upper retaining sleeve, retaining sleeve 5 in FIG. 1, is also interchangeable.

Figure 2:
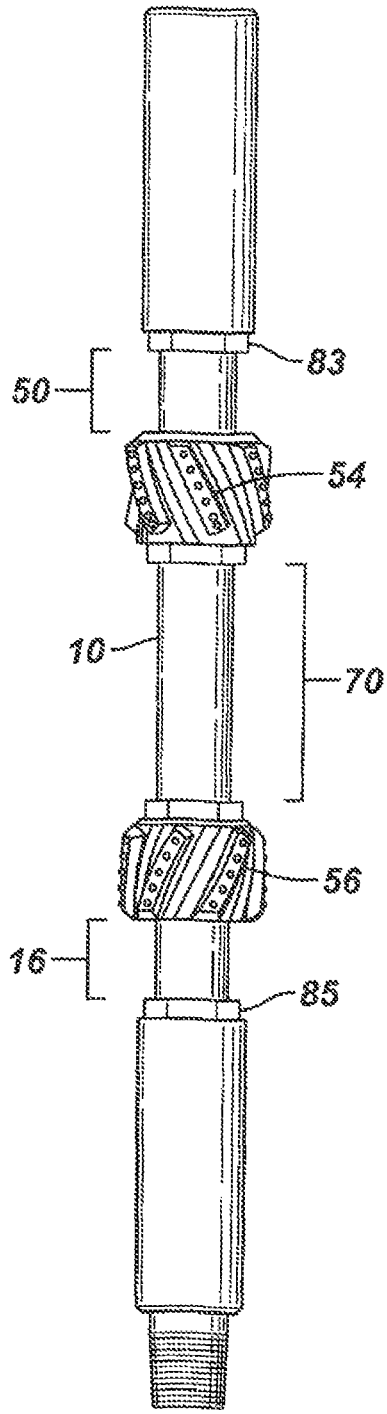
FIG. 2 is an illustration of a mandrel without any inserts, profiles or clamps.

FIG. 2 is an illustration of mandrel 10 from FIG. 1 without inserts, housings, or profiles. In general, at least one slot 54 is cut into of mounting portion 50 and one slot 56 is cut into mounting portion 16. FIG. 2 also illustrates a hex connection 83 and a hex connection 85.

Figure 3:
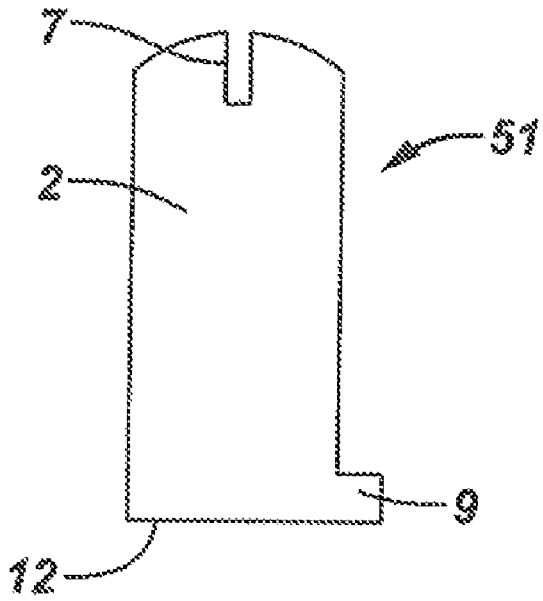
FIG. 3 is an illustration of a cross-section of the spring loaded blade insert from FIG. 1.

Now referring to FIG. 3, an illustration of a cross-section of scraper blade insert 51 is disclosed. The cross-section illustrated discloses a blade 2, a tongue or foot 9, a spring loaded base 12, and wear indicator 7. Generally, insert 51 has a series of biased members or multiple biased members, such as springs and/or the like, counter-sunk into base 12. In an embodiment, foot 9 is the biased member. Insert 51 is slid into slot 54 such that the biased member is positioned between the mounting portion, or mandrel, and the insert, biasing the insert outwardly from the mandrel towards the casing. Wear indicator 7 is capable of use to indicate when insert 51 should be replaced. In various embodiments, no foot or tongue is present.

Figure 4:
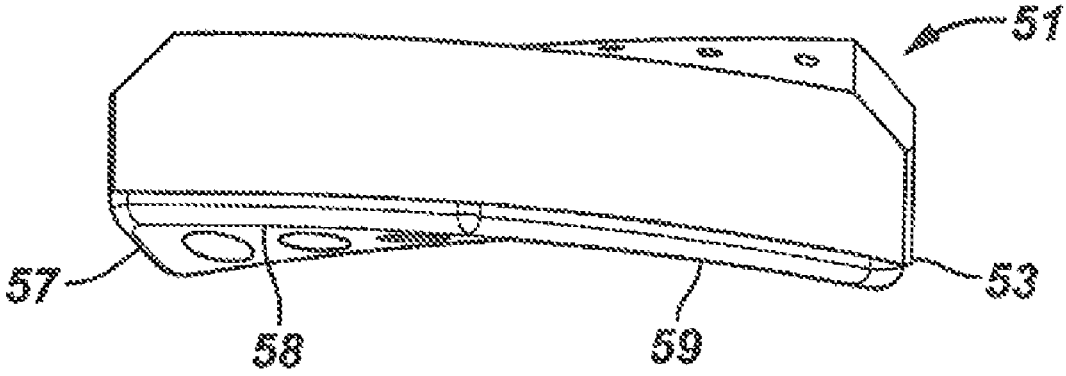
FIG. 4 is an illustration of the spring loaded blade insert from FIG. 1.

Now referring to FIG. 4, an illustration of a spring loaded blade insert 51 is disclosed. Generally, scraper blade insert 51 is contoured generally to the shape of the mandrel such that insert 51 slides into slot 54 and/or slot 56 from FIG. 2. In an embodiment, the shape of insert 51 is arcuate. The edges 53, 57, 58, and 59 of scraper blade insert 51 are generally beveled to dull the edges of the insert. Beveled edges are less likely to gouge the casing as the tool is raised and lowered in the wellbore.

In an embodiment, the scraper insert has blades on each side such that the scraper insert is capable of scraping a surface of the wellbore as the tool is both raised and lowered in the wellbore.

Now referring to FIG. 5, an illustration of a spring loaded downhole tool 100 with brush inserts comprising at least one individually spring loaded pod is disclosed. Tool 100 generally comprises at least one insert 105, with a passageway therehtrough, with at least one individually spring loaded pod 110, mandrel 120, profile 115, and profile 117.

Generally, in an embodiment, mandrel 120 is of a generally similar size and/or circumference along its length with at least three cut away portions 140, 150, and 160. Cut away portion 140 is of a sufficient depth to allow mounting of insert 105 to a mounting slot within mounting portion 102. Likewise, cut away portion 150 is of a sufficient depth to allow mounting of insert 107 to a slot within mounting portion 104. Cut away portion 150 is an optional component and allows for interchangeable mounting of various tool enhancers, such as, but not limited to a magnetic portion, a tru-gauge portion, a flow area enhancement portion, and/or the like.

In an alternate embodiment, first mounting portion 102 is an enlarged portion of mandrel 120 of sufficient thickness to allow machining of a mounting slot for at least one first insert 105. Likewise, in this alternate embodiment, second mounting portion 104 is an enlarged portion of mandrel 120 of sufficient thickness to allow machining of a mounting slot for at least one second insert 107.

Inserts of the present invention are inserted into at least one slot cut into the mounting portions from the outermost ends and not from the center. In an embodiment, at least one insert is inserted into a slot in mounting portion from the outermost side and slid towards the center. Likewise, at least one insert is inserted into a slot in mounting portion from the outermost side and slid towards the center.

Slots in mounting portion 102 and/or mounting portion 104 can generally be any size desired that is capable of accepting an insert. In an embodiment, the slots are wedged shaped. In an alternate embodiment, the slots are L-shaped. In an alternate embodiment, the slots will provide the biasing member. In an alternate embodiment, the slots allow for insertion of a retaining tongue.

Slots in mounting portion 102 and/or mounting portion 104 can generally be cut at any orientation and/or angle from the longitudinal axis of the mandrel that allows at least one first and at least one second insert to be inserted from the outermost side. In an embodiment, all of the slots in mounting portion 102 are cut at generally the same angle. Likewise, in an embodiment, all of the slots in mounting portion 104 are cut at generally the same angle. Any number of slots can be used in each of mounting portion 102 and mounting portion 104. In an embodiment, the angle of orientation of the at least one slot is greater than 10 degrees from the longitudinal axis of the mandrel. In an alternate embodiment, the angle of orientation is greater than 20 degrees from the longitudinal axis of the mandrel. In an alternate embodiment, the angle of orientation is greater than 30 degrees from the longitudinal axis of the mandrel. In an alternate embodiment, the angle of orientation is greater than 40 degrees from the longitudinal axis of the mandrel. In an alternate embodiment, the angle of orientation is greater than 50 degrees from the longitudinal axis of the mandrel. In an alternate embodiment, the angle of orientation is greater than 60 degrees from the longitudinal axis of the mandrel. In an alternate embodiment, the angle of orientation is greater than 70 degrees from the longitudinal axis of the mandrel. In an alternate embodiment, the angle of orientation is greater than 80 degrees from the longitudinal axis of the mandrel.

Generally, the orientation/angle and number of slots is chosen to provide 360° coverage around mounting portion 102 and/or mounting portion 104. In an alternate embodiment, 360° coverage is provided by combination of mounting portion 102 and mounting portion 104.

Further interchangeable adaptations possible with embodiments of the present invention include interchangeable housing portions (clamp) located between the first insert and the second insert. Various embodiments of interchangeable housing portions include, but are not limited to, a blanking portion, a magnetic portion, a flow area enhancement portion, combinations of the aforesaid, and/or the like. The embodiment in FIG. 5 illustrates a tru-gauge clamp 125 held in place on mandrel 120 by locking dog 135, in this case, a pair of locking dogs and/or retention clamps.

Profiles of the present invention are interchangeable. In an embodiment, the lower profile, profile 117 in FIG. 5, is interchangeable between a tapered mill profile, a top dress profile, a flow area enhancement profile and/or the like. In a tapered mill profile, a degree of taper is capable of selection relative to the desired drilling, milling, fishing, workover or any other cased hole intervention operation and/or the like. As well, the upper profile, profile 115 in FIG. 5, is also interchangeable.

Further embodiments of the preset invention generally comprise a combination of inserts, both scraper and brush, on the same tool. In an embodiment, one mounting portion has scraper inserts and another mounting portion has brush inserts. In an alternate embodiment, a third or more mounting portion is added with any or both of brush inserts and scraper inserts.

Now referring to FIG. 6, an illustration of a spring loaded insert 110 is disclosed. In an embodiment, insert 110 generally comprises at least one individually spring loaded wire pod 150 comprising at least one port, a insert member 111 comprising tongue or foot 114 with at least one passageway 113 extending therethrough, a biasing member 145, and a wire filament 112. Pod 150 generally encases an end of wire filament 112 wherein an end of the filament 112 is crimped over a support, such as by bending over a bar. In other embodiments, the wire may be notched and secured on a shelf or extending structure from the pod. In other embodiments, at least one of the wire filaments is bent over the support. In all embodiments with pods, the pod is biased against/from the mandrel and insert 110 is capable of floating relative to the mandrel within the slot. The mandrel and the pod are therefore the biasing members. In various embodiments, at least one passageway extends through insert member 111 for each pod 150. In various embodiments, insert member 111 is not tongued and is retained by other means, such as being wedge shaped and/or the like.

An embodiment of the present invention comprises a spring loaded wire brush insert positioned within the passageway of the insert and biased outwardly from the mandrel, the spring loaded wire brush insert comprising a body with at least one passageway; at least one wire filament secured at least partially within the spring loaded wire brush insert, and wherein the at least one wire filament at least partially extends through the port on the body, whereby the at least one wire filament is capable of contacting a surface of a casing. Further embodiments comprise a drill string and a housing portion, wherein the spring loaded wire brush insert is slidingly received within a slot on a first mounting portion on the mandrel In various embodiments, the insert is slidingly received from the outermost end.

Further embodiments secure the insert by a retaining sleeve or profile.

Various embodiments are assembled in various biasing arrangements. In an embodiment, the at least one pod and the at least one biasing member, such as a spring, are associated with one another. In an alternate embodiment, multiple pods are associated with one biasing member. In an alternate embodiment, multiple biasing members are associated one pod. In an alternate embodiment, multiple pods are associated with multiple biasing members.

Several advantages are realized by using spring loaded wire brush inserts of the present invention, such as in the case of repair, allowing for individual pod and/or brush insert replacement, allowing for varied biased members across the insert, allowing for greater casing contact in deviated section of the casing, allowing of ease of change between scraper inserts and brush inserts, allowing for float of the pod inserts and/or the wire brush inserts regardless of casing ovality/inner casing diameter variances thereby reducing and/or eliminating the occurrences of tram lines where fixed radiuses don't match up; allowing for an improved high contact system; allowing for ease of removal of brush inserts, improving safety of personnel during removal and/or changing operations, and/or the like.

No embodiments of the present invention comprise a first spring loaded brush insert and a second spring loaded brush insert operatively associated with the tool, wherein the spring loaded brush insert comprises a mandrel having a slot; an insert received within the slot, wherein the insert has a first section containing an opening for placing a wire filament therethrough; a spring, positioned between the mandrel and the brush insert for biasing the brush insert against the inner diameter of the casing string. All embodiments of brush inserts the present invention comprise at least one individually spring loaded pod or spring loaded insert for enhanced casing cleaning.

Figure 7:
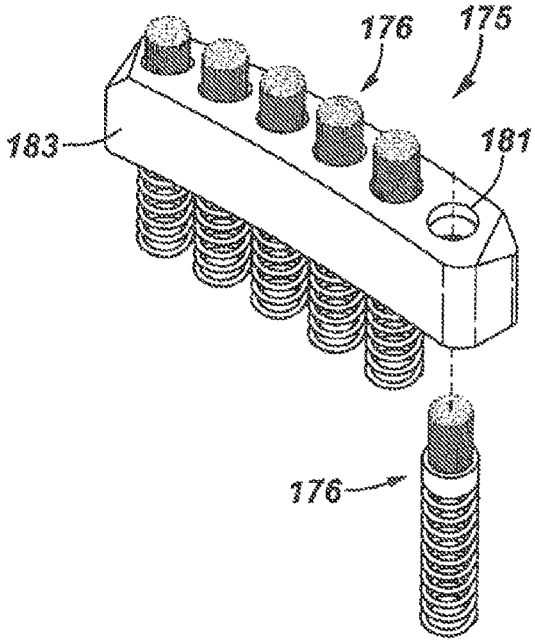
FIG. 7 is an illustration of pod-loaded insert with a passageway therehtrough from FIG. 5.

FIG. 7 is an illustration of a pod-loaded insert 175 comprising at least one individually spring loaded pod 176, spring loaded brush insert 178, tongued insert/biasing member 183, and access passageway 181. The fixed blade will be secured to the mandrel in combination with the slot profile and blade profile. The spring loaded pods will be retained within correlating blade profiles and at independently to the blade. The spring mechanism in combination with the wire pod will be operable and secured within the bored sections of the blade. The wire filaments will be secured to the pod housing by means of a positive locking system. The wire strands, composing of the wire filament, will be folded, twisted, and/or crimped to reduce wire fatigue and improve casing wall contact and/or cleaning. The wire extension, beyond the blade outer diameter, will remain short, rigid, and/or abundant thus providing for an enhanced casing inner diameter cleaning.

Figure 8:
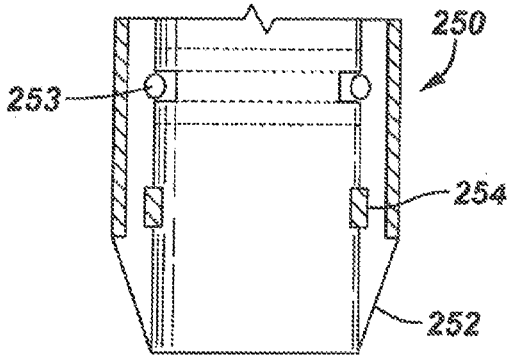
FIG. 8 is an illustration of an embodiment of an interchangeable profile capable of use with embodiments of the present invention.

FIG. 8 is an illustration of an embodiment of a profile 250 with a gradual tapered mill. Taper 252 can be varied as desired. Profile 250 is secured to a mandrel by any means common in the art. In an embodiment, a retaining key locking feature is used to secure the retaining sleeve. In an embodiment of the locking feature, a locking mechanism will be inserted and isolated within the mounting region. In various embodiments, the retaining key locking feature is locking dogs, retaining keys 254, ball(s) 253, locking wire, screw, bolts, threaded connection, fastner, interference fit, and/or the like. In an embodiment, the retaining device(s) are capable of providing the tensile and compressional resistance necessary to secure the various inserts in the slots during drilling operations. Accordingly, the profiles of the present invention secure the various inserts in the slots.

In various embodiments, an additional locking mechanism, or profile, will be positioned to secure the retaining sleeve torsionally thus not allowing the sleeve to rotate opposite the mandrel. In an embodiment, the retaining sleeves will be positioned over the undercuts in the mandrel. In an alternate embodiment, the retaining sleeve is held in place by alternate means, such as, but not limited to a screw thread, at least one bolt, a pin, a hex fitting, a bearing, a gear, a spline, and/or the like. Generally, any method common in the art can be used to secure the sleeve to the mandrel.

In an embodiment, the undercuts will accept two stainless (or similar material) split halves with the locking profile machined to coincide with the retainer sleeve locking profile. Once aligned, the locking mechanism(s) are capable of being inserted, thus locking the two components together. These split halves are designed to be interchangeable and used to preserve the mandrel integrity and life.

Figure 9:
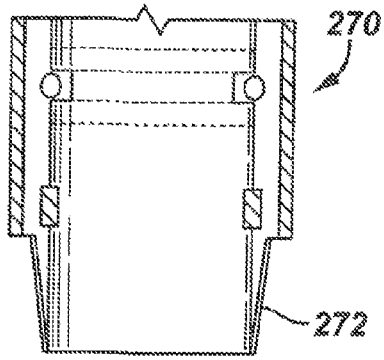
FIG. 9 is an illustration of an alternate embodiment of an interchangeable profile capable of use with embodiments of the present invention.

FIG. 9 is an illustration of a top dress tapered mill profile 270 with a taper 272.

Figure 10:
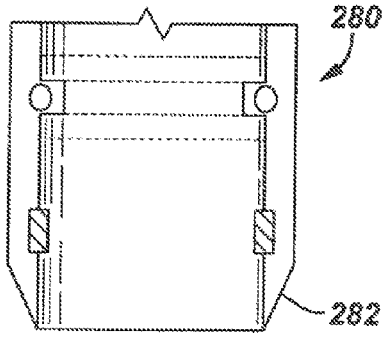
FIG. 10 is an illustration of an alternate embodiment of an interchangeable profile capable of use with embodiments of the present invention.

FIG. 10 is an illustration of a sharp tapered mill profile 280. The taper 282 is less than that of FIG. 8, thereby illustrating that a taper of a profile on a retaining sleeve of the present invention can be modified.

Figure 11:
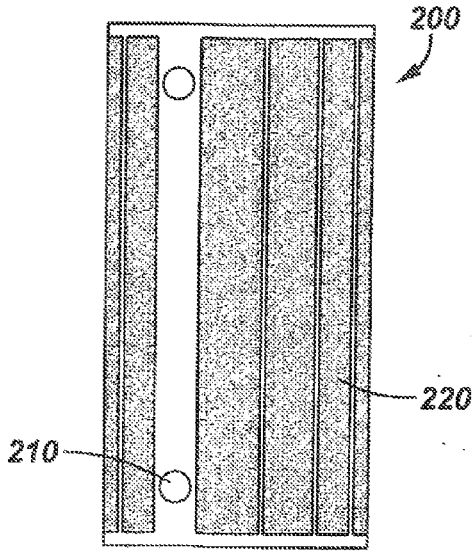
FIG. 11 is an illustration of an embodiment of an interchangeable housing capable of use with various embodiments of the present invention.

FIG. 11 is an illustration of a magnetic housing portion 200. In the embodiment illustrated in FIG. 1, housing portion 200 is secured in cut away portion 70 by locking dog(s) 210. Referring back to FIG. 11, housing portion 200 has ports for accepting the locking dogs. The locking dogs will prevent and/or resist rotation of the housing portion. In this embodiment, magnetic bars 220 are slid into carriers/slots on portion 200.

A housing portion of the present invention is generally a sheet of material or materials that is wrapped around the mandrel. The sheet can be secured by any means common in the art, such as, but not limited to bolting, welding, screwing, stabbing, and/or the like.

The embodiment in FIG. 11 comprises magnetic portions. The magnetic portion can be added by any means. The magnetic portion can be used to remove metallic debris from the wellbore, thereby reducing the amount of metallic material in the drilling, completion, and/or wellbore fluid and increasing and/or improving the service life and condition of those fluids, tools, subsequent wellbore activities and/or the like.

Figure 12:
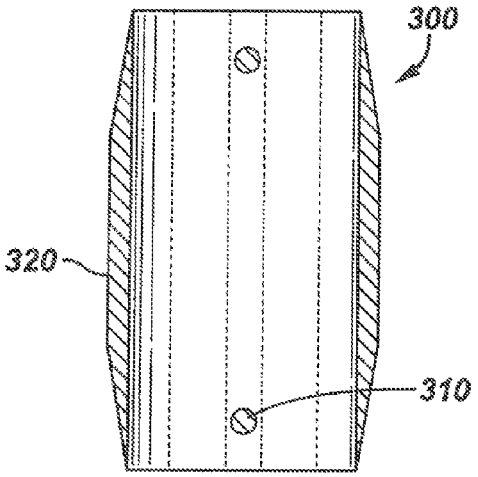
FIG. 12 is an illustration of an alternate embodiment of an interchangeable housing capable of use with various embodiments of the present invention.

FIG. 12 is an illustration of a tru-gauge housing portion 300. The tru-gauge is a positive casing drill and/or gauging device used to simulate other downhole equipment and/or jewelry to be utilized or deployed in the casing and/or the wellbore on subsequent well intervention runs.

Figure 13:
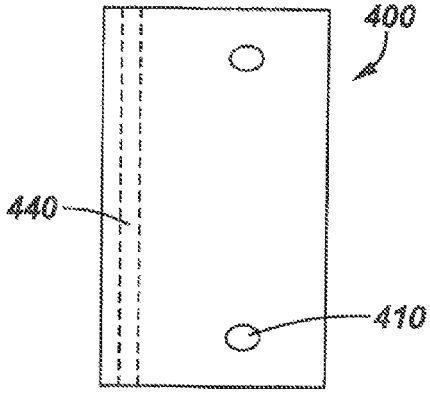
FIG. 13 is an illustration of an alternate embodiment of an interchangeable housing capable of use with various embodiments of the present invention.

FIG. 13 is an illustration of a blanking housing portion 400. The illustration of blanking housing portion 400 provides an alternate/additional means of securing the sheet, such that a bar or key 440 can be used to connect the opposing ends of the sheet of the housing portion.

In an embodiment, the blanking housing provides protection to the mandrel should no other mid section option be utilized.

Figure 14:
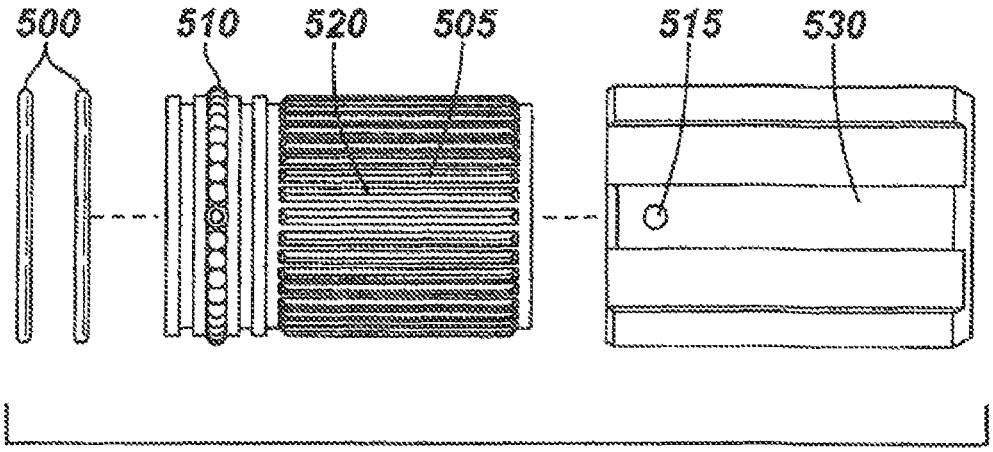
FIG. 14 is an illustration of a geared stabilizer spline for securing a profile.

FIG. 14 discloses an alternate embodiment of a profile and insert locking mechanism. In general, a cut-away portion 140 and/or cut-away portion 160 from FIG. 5 has a geometrical shaped surface and profile retainer 505 has a complimentary geometrically shaped interior surface such that retainer 505 locks does not rotate when when inserted into place. Ribs or gears 520 cooperate with an interior surface of profile 530 to resist rotation. Further locking of profile 530 can be achieved with the use of a bearing system 510. In various embodiments, gaskets 500 are used to prevent or inhibit drilling fluid or other fluid from passing between profile 530 and retainer 505.

Figure 15:
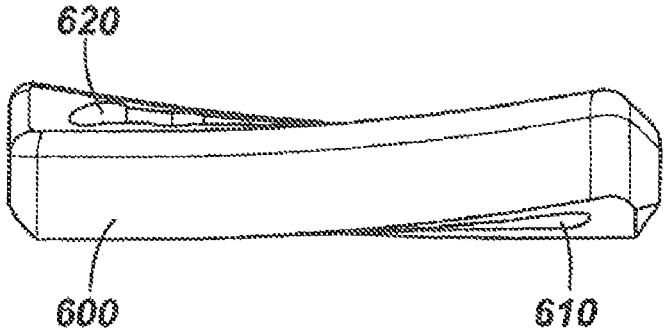
FIG. 15 is an illustration of an insert with a passageway therehtrough of an alternate embodiment of the present invention.
Figure 16:
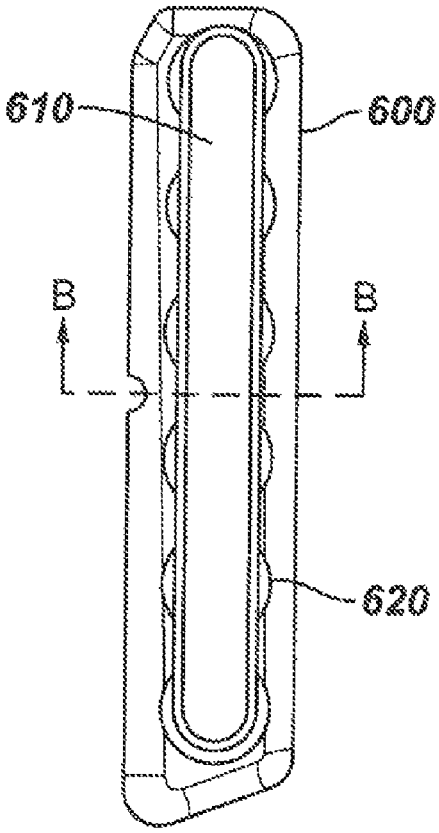
FIG. 16 is an illustration of the insert of FIG. 15 from an underside perspective.
Figure 17:
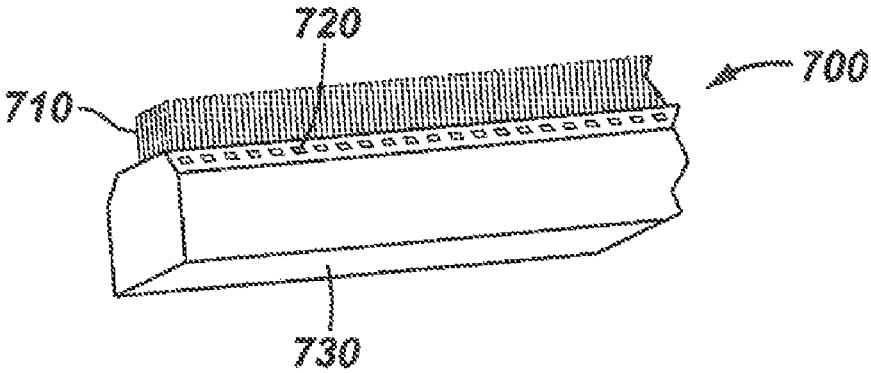
FIG. 17 is an illustration of a brush insert for use in the insert of FIGS. 15 and 16.

FIG. 15 is an illustration of a spring loaded insert 600 capable of use in various embodiments of the present invention. Passageway 610 is elongated along a base of insert 600. Cut-out 620 extend through insert 600 as is better seen with reference to FIG. 16. Generally, FIG. 16 illustrates passageway 610 is tapered such that when a wire brush insert as disclosed in FIG. 17 is inserted into passageway 610 the taper does not allow the wire brush insert to pass through passageway 610. The taper can be gradual, arcuate, shelf like, or generally any other taper common in the art and capable of resisteing the wire brush insert from passing through spring loaded insert 610.

Cut-out 620 is generally any shape capable of allowing a biasing member to bias the mandrel and a wire brush insert. In an embodiment, a circular wound spring is used and cut-out 620 is generally circular in shape extending at least a portion of the distance through insert 600, but not through insert 600.

FIG. 17 discloses a wire brush insert 700 capable of use with embodiments of the present invention comprising a base 730 and at least one wire filament 710. Generally, any method of securing wire filaments 710 within insert 700 is capable of use in various embodiments. In an embodiment, wire filament 710 is secured in insert 700 by crimping of insert 700 such that insert 700 is tapered inwardly from base 730 in at least portion 720. Generally, any manner of securing wire filament 710 is capable of use.

Also disclosed are methods of cleaning a wellbore comprising the steps of lowering or raising a drill string comprising at least one spring loaded wellbore cleaning tool into a wellbore to at least one section of casing that needs cleaning, the tool comprising at least one spring loaded brush insert as herein disclosed; and, cleaning the at least one section by rotating the drill string, whereby each of the at least one spring loaded pods is biased outwardly from the mandrel towards the at least one section of casing wherein the at least one section of casing is brushed. Further embodiments comprise a step of scraping the at least one section of casing. Further embodiments comprise a step of magnetically attracting metallic debris within the at least one section of casing. Further embodiments comprise the step of centering the tool within the wellbore.

Further embodiments comprise the step of circulating a drilling fluid through the inner diameter of the work string.

Methods and apparatuses of the present invention are particularly useful in drill strings with deviated sections. However, a tool of the present invention will work in any wellbore, deviated or not.

As such, embodiments of the present invention are particularly meant to cover a wellbore cleaning tool comprising a mandrel connected to a drill string, said mandrel comprising; at least a first insert with a passageway therethrough; at least a second insert; and, a housing portion, wherein at least said first insert comprises a spring loaded brush insert with a passageway therethrough, wherein said spring loaded brush insert is biased outwardly with a biasing member from said mandrel, and further wherein said first insert and said second insert are slidingly received within a slot on a first mounting portion on said mandrel and a slot on a second mounting portion on said mandrel, from the outermost respective ends, and wherein said first insert is secured by a first retaining sleeve and said second insert is secured by a second retaining sleeve; a spring loaded wellbore cleaning tool comprising a mandrel connected to a drill string; at least a first insert with a passageway therethrough; at least a second insert; and, a mid housing portion, wherein said first insert is selected from at least one of a scraper insert for scraping a surface of at least one section of casing and at least one spring loaded brush insert selected from a spring loaded pod and a spring loaded wire brush insert, and further wherein said first insert and said second insert are slidingly received within a slot on a first mounting portion on said mandrel and a slot on a second mounting portion on said mandrel, from the outermost respective ends, and wherein said first insert is secured by a first retaining sleeve and said second insert is secured by a second retaining sleeve, wherein said spring loaded brush insert is biased against the mandrel; a spring loaded brush insert comprising at least one individually spring loaded pod comprising a body with at least one passageway and at least one wire filament secured at least partially within said body and extending through said passageway; and, at least one insert member with at least one passageway extending therethrough wherein said pod is biased outwardly from said mandrel and further wherein said at least one wire filament is capable of contacting a surface of a casing; and, a method of cleaning a wellbore comprising the steps of lowering, raising or rotating a drill string comprising at least one springy loaded wellbore cleaning tool into a wellbore to at least one section of casing that needs cleaning, said tool comprising at least one brush insert comprising a spring loaded brush insert selected from a spring loaded pod and a spring loaded wire brush insert; and, cleaning said at least one section by rotating said drill string, whereby said spring loaded pod is biased outwardly from the bottom portion of the blade towards said at least one section of casing wherein said at least one section of casing is brushed.

While a particular embodiment of the invention has been shown and described, numerous variations and alternate embodiments will occur to those skilled in the art. Accordingly, it is intended that the invention be limited only in terms of the appended claims.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes to the claims that come within the meaning and range of equivalency of the claims are to be embraced within their scope. Further, all published documents, patents, and applications mentioned herein are hereby incorporated by reference, as if presented in their entirety.

What is claimed is:

1. A downhole tool for connection in a tubing string for use in cleaning wellbores, comprising:

a mandrel assembly comprising an elongated tubular mandrel with a passageway extending axially through the mandrel and a retainer mounted on the mandrel such that relative axial and rotational movement with respect to the mandrel is limited, the retainer having a cylindrical outer surface, at least one axially extending groove and one annular groove formed in the outer surface; and a wellbore cleaning element mounted to extend from the exterior of the mandrel into contact with the wellbore when the tubing string and tool are moved within the wellbore; and a sleeve mounted on the exterior of the mandrel for contacting the wellbore, axially extending ribs on the interior of the sleeve of a size and shape to mate with the ribs on the exterior of the retainer to restrict relative rotation of the sleeve with respect to the mandrel, and an annular groove on the interior of the sleeve located adjacent to the axially extending groove in the retainer, spheres located in the groove on the retainer, the spheres extending into the groove in the sleeve whereby relative axial movement between the sleeve and the mandrel is limited.

2. The downhole tool of claim 1 additionally comprising a geometric shape on the exterior of the mandrel and a complementary geometric shape on the retainer engaging the geometric shape on the mandrel to limit rotation of the retainer with respect to the mandrel.

3. The downhole tool of claim 2 wherein the geometric shape on the mandrel is polygonal.

4. The downhole tool of claim 2 wherein the geometric shape on the mandrel is hexagonal.

5. The downhole tool of claim 1 wherein the retainer is a sleeve.

6. The downhole tool of claim 1 wherein the retainer has a one-piece construction.

7. The downhole tool of claim 1 wherein the cleaning element is mounted in a slot in the exterior of the mandrel.

8. The downhole tool of claim 1 wherein the cleaning element is resiliently urged in a direction radially away from the mandrel.

9. The downhole tool of claim 8 wherein the cleaning element is selected from the group consisting of a brush and a scraper.

10. A downhole tool for connection in a tubing string for use in cleaning wellbores, comprising:

an elongated tubular mandrel, a slot in the exterior of the mandrel and a brush assembly mounted in the slot, the brush assembly comprises:

a biasing member having a plurality of passageways, the passageways extend radially through the biasing member when the biasing member is mounted on the mandrel;

an independently movable brush element mounted in each of the plurality of biasing member passageways, each brush element comprising a plurality of wire filaments joined together at one end and positioned with the other filament ends extending radially outward through one of the passageways in the biasing member, and separate compression springs mounted to extend into each passageway and contact a brush member to bias the brush member radially away from the mandrel.

11. The wellbore clean out tool of claim 10 wherein the passageways in the biasing member is a slot.

12. The wellbore clean out tool of claim 10 wherein the spring is a coil spring.

13. The wellbore clean out tool of claim 10 wherein the passageways in the biasing member are bores.

* * * * *